US008413365B2

(12) United States Patent
Jung et al.

(10) Patent No.: US 8,413,365 B2
(45) Date of Patent: Apr. 9, 2013

(54) TRAJECTORY ADJUSTMENT APPARATUS

(75) Inventors: In Jung, Gyeonggi-do (KR); Dong Hee Lee, Gyeonggi-do (KR)

(73) Assignee: In Jung, Gyeonggi-do (KR)

( * ) Notice: Subject to any disclaimer, the term of this patent is extended or adjusted under 35 U.S.C. 154(b) by 0 days.

(21) Appl. No.: 13/062,535

(22) PCT Filed: Sep. 9, 2009

(86) PCT No.: PCT/KR2009/005105

§ 371 (c)(1),
(2), (4) Date: Mar. 7, 2011

(87) PCT Pub. No.: WO2010/030115

PCT Pub. Date: Mar. 18, 2010

(65) Prior Publication Data

US 2011/0154713 A1 Jun. 30, 2011

(30) Foreign Application Priority Data

Sep. 11, 2008 (KR) ..... 10-2008-0089807

(51) Int. Cl.
*F41G 1/00* (2006.01)

(52) U.S. Cl.
USPC ..... 42/137

(58) Field of Classification Search ..... 42/126, 42/137

See application file for complete search history.

(56) References Cited

U.S. PATENT DOCUMENTS

| | | | | |
|---|---|---|---|---|
| 1,970,623 | A * | 8/1934 | Redfield | 42/137 |
| 2,165,785 | A * | 7/1939 | Burton | 42/137 |
| 2,402,263 | A * | 6/1946 | Siedlarz | 42/137 |
| 3,662,469 | A * | 5/1972 | Charron | 42/137 |
| 4,021,926 | A * | 5/1977 | Hrebar | 42/137 |
| 4,911,060 | A | 3/1990 | Greenspan et al. | |
| 4,993,833 | A | 2/1991 | Lorey et al. | |
| 5,555,662 | A | 9/1996 | Teetzel | |
| 5,720,270 | A * | 2/1998 | Meicke | 124/87 |
| 6,513,276 | B2 * | 2/2003 | Mendoza-Orozco | 42/137 |
| 6,591,538 | B2 * | 7/2003 | Holler | 42/125 |
| 7,121,037 | B2 | 10/2006 | Penney | |
| 7,870,688 | B1 * | 1/2011 | Dasiukevich | 42/124 |
| 2002/0152664 | A1 * | 10/2002 | Mendoza-Orozco | 42/137 |
| 2011/0308133 | A1 * | 12/2011 | Nemec | 42/137 |

FOREIGN PATENT DOCUMENTS

KR 100906159 B1 6/2009

OTHER PUBLICATIONS

Search Report for PCT/KR2009/005105, dated May 12, 2010, 2 pages.

* cited by examiner

*Primary Examiner* — Samir Abdosh

(74) *Attorney, Agent, or Firm* — Dority & Manning, P.A.

(57) ABSTRACT

Disclosed is a trajectory correction apparatus arranged between a firearm and a sight, the trajectory correction apparatus including: a trajectory correction device which includes a mount mounted to a firearm body, a moving body having a projection at one side and arranged on an upper side of the mount, a joint shaft rotatably inserted in the moving body, a rotation shaft penetrating in a direction perpendicularly intersecting the joint shaft and installed to the mount, an adjusting member adjusting a vertical rotation angle of the moving body, and a guide plate obliquely formed thereon with a guide groove, in which the projection is inserted, and fastened to one side of the mount to horizontally rotate the moving body as the moving body vertically rotates.

8 Claims, 16 Drawing Sheets

TRAJECTORY ADJUSTMENT APPARATUS

CROSS-REFERENCE TO RELATED APPLICATION

This application is the national stage entry of International Patent Application No. PCT/KR2009/005105 having a filing date of Sep. 9, 2009, which claims priority to and the benefit of Korean Patent Application No. 10-2008-0089807 filed in the Korean Intellectual Property Office on Sep. 11, 2008, the entire contents of which are incorporated herein by reference.

BACKGROUND OF THE INVENTION (a) Field of the Invention

The present invention relates to a trajectory correction apparatus, and more particularly, a trajectory correction apparatus for a dot sight, a scope or the like sight, which can improve an accuracy rate by correcting that a bullet hurled from a muzzle is affected by the gravity, the Coriolis' force caused by the rotation of the earth, the direction of wind, etc. and misses a target.

(b) Description of the Related Art

In the case of firearms, a trajectory is divided into an internal trajectory (or internal ballistics) from time when a bullet starts moving due to combustion and explosion of propulsive chemical substances in a gun barrel to time when the bullet leaves a muzzle or an open end of a gun (hereinafter, referred to as the "muzzle"), an external trajectory (or external ballistics) that the bullet coming out from the muzzle describes in the air, and a piercing trajectory that the bullet describes piercing the inside of the target after impact. According to difference in outward influences on the bullet, the trajectory is also divided into a vacuum trajectory affected by only the gravity of the earth without resistance of the air, and an air trajectory actually described in the air.

In the firearms, the external trajectory • the air trajectory are determined by external factors such as inertia based on initial velocity (direction and propulsive force) at a moment when the bullet leaves the muzzle, air resistance in the air, gravitation of the earth (the acceleration of gravity), Coriolis' force (deflecting force) caused by the rotation of the earth, etc.

In other words, the bullet leaving the muzzle is affected by not only the gravity with respect to a vertical direction to thereby fall down while forming a parabola, but also the Coriolis' force (deflecting force) with respect to a horizontal direction to thereby deflect the moving direction of the bullet rightward in the northern hemisphere. Further, the bullet leaving the muzzle deviates laterally from an aiming point on account of the direction and speed of wind while moving to the target.

Thus, in the case of a conventional personal gun, in order to hit a chest on a target board shaped like an upper half of a person's body, a part a little under a navel is aimed at a distance of 100 m, a navel part is aimed at a distance of 200 m, the chest is rightly aimed at a distance of 250 m, and so on by taking the foregoing trajectory into account. That is, the target is false aimed and shot in consideration of the trajectory. In result, the target is aimed not correctly but by a shooter's experience, and therefore correction considering the horizontal trajectory affected by the Coriolis' force (deflecting force) or an error caused by the direction of wind also depends on individual difference so as to false aim and shoot the target, thereby lowering an accuracy rate.

SUMMARY OF THE INVENTION

Accordingly, the present invention is conceived to solve the forgoing problems, and an aspect of the present invention is to provide a trajectory correction apparatus, which can improve an accuracy rate by rightly aiming and shooting a target through a dot sight, a scope or the like sight as an error is corrected in consideration of a vertical trajectory and a horizontal trajectory according to distance from the target, and which can automatically correct the horizontal trajectory when the vertical trajectory is corrected depending on the distance from the target.

Also, it is to provide a trajectory correction apparatus, in which a trajectory is corrected through two or more adjusting members to thereby make fine adjustment possible in accordance with the distance from the target, and an adjustable range of each adjusting member is divided according to the distance from the target to thereby quickly and correctly correspond to the distance from the target.

Further, it is to provide a trajectory correction apparatus which can prevent a corrected trajectory from being lost by a shock at percussion.

Furthermore, it is to provide a trajectory correction apparatus which can improve an accuracy rate by correcting an error that a bullet deviates from a target on account of the direction and speed of wind while the bullet hurled from a muzzle arrives at the target.

In accordance with an aspect of the present invention, there is provided a trajectory correction apparatus arranged between a firearm and a sight, the trajectory correction apparatus comprising: a trajectory correction device which comprises a mount mounted to a firearm body, a moving body having a projection at one side and arranged on an upper side of the mount, a joint shaft rotatably inserted in the moving body, a rotation shaft penetrating in a direction perpendicularly intersecting the joint shaft and installed to the mount, an adjusting member adjusting a vertical rotation angle of the moving body, and a guide plate obliquely formed thereon with a guide groove, in which the projection is inserted, and fastened to one side of the mount to horizontally rotate the moving body as the moving body vertically rotates.

In the guide plate, a lateral side of a guide groove with which the projection becomes in contact in accordance with adjusting steps of a vertical rotating angle of the moving body may be formed as a vertical plane.

Two or more adjusting members may be provided, and the respective adjusting members may be different in an adjustable range for the rotation angle of the moving body.

The adjusting member may comprise a coaxial shaft, and a polygonal cam formed with a plurality of contact surfaces formed to be different in distance from a center of the coaxial shaft from one another and to be surface-contact with the moving body in accordance with distance from an impact point of a bullet.

The trajectory correction apparatus may further comprise an elastic member interposed between the mount and the moving body and elastically supporting the moving body in one direction.

The trajectory correction apparatus may further comprise a wind correcting device which is provided between the trajectory correcting device and the sight and horizontally rotates the sight in accordance with direction and speed of wind.

The wind correcting device may comprise a base fastened to an upper side of the moving body of the trajectory correcting device, a sight installing platform arranged on an upper side of the base, a pivot penetrating the sight installing platform and installed in the base, and a moving unit horizontally rotating the sight installing platform with respect to the pivot.

The moving unit may comprise a joint shaft rotatably inserted in the sight installing platform, and an adjusting shaft having one end coupled to the joint shaft and the other end rotatably installed to the base, and the joint shaft and a coupling part of the adjusting shaft or the adjusting shaft and a coupling part of the base are screw-coupled.

DETAILED DESCRIPTION OF THE EMBODIMENTS

Figure 1:
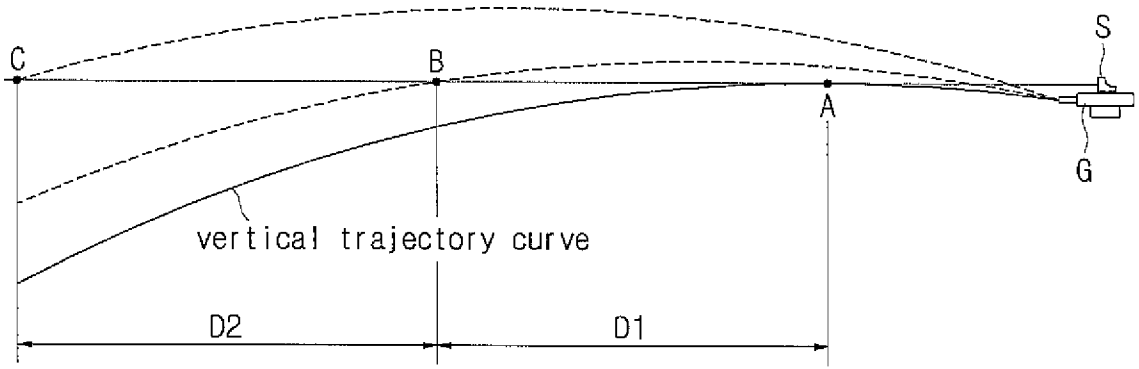
FIG. 1 is a schematic view showing a trajectory curve of a bullet affected by gravity in a vertical direction.

Prior to description, a first exemplary embodiment among many exemplary embodiments will representatively explain elements, and other exemplary embodiments will describe only different elements from those of the first exemplary embodiment, in which like reference numerals refer to like elements throughout the embodiments.

Hereinafter, a trajectory correction apparatus according to a first exemplary embodiment of the present invention will be described with reference to the accompanying drawings.

Figure 3:
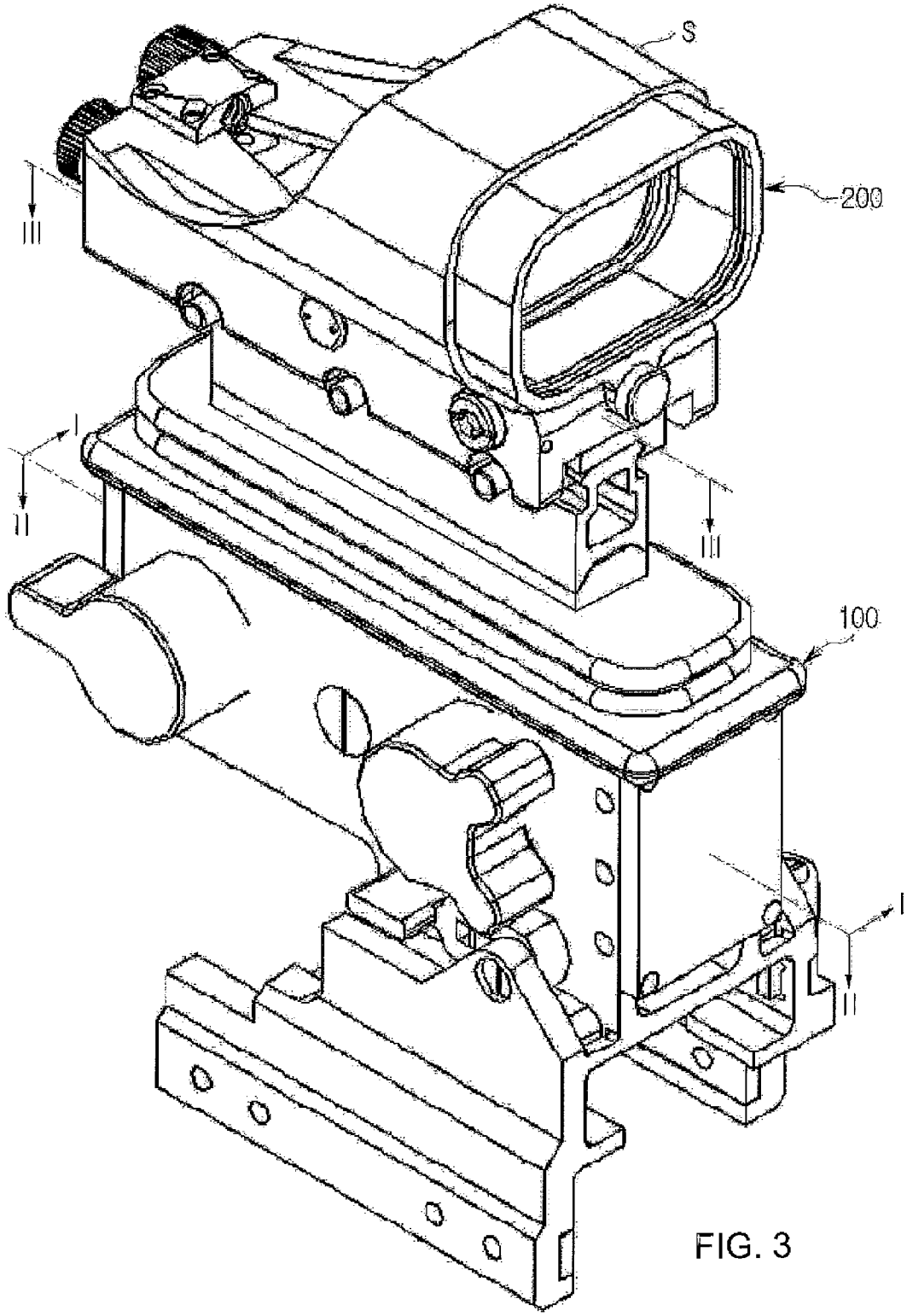
FIG. 3 is a perspective view of a trajectory correction apparatus according to an exemplary embodiment of the present invention.
Figure 4:
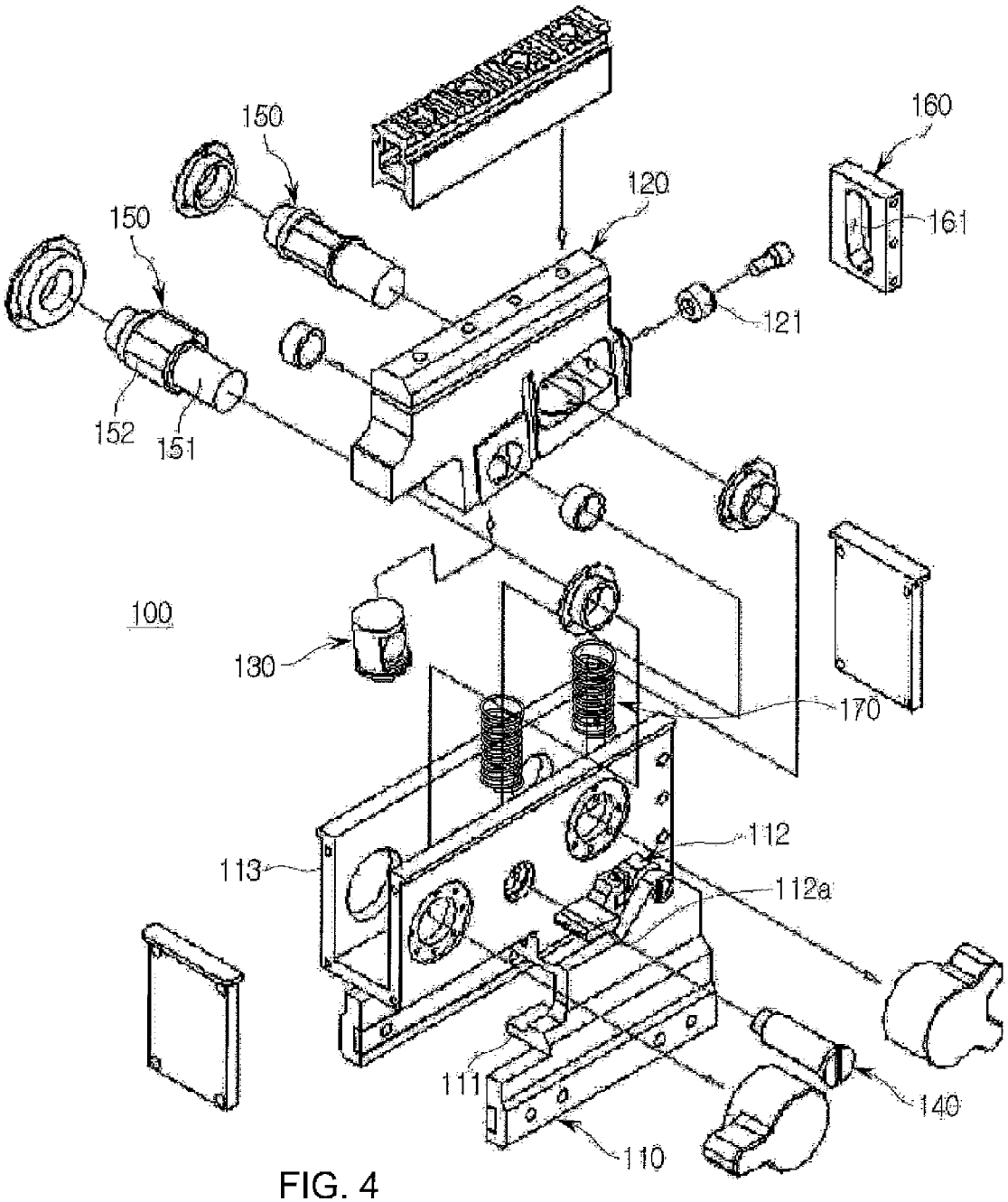
FIG. 4 is an exploded perspective view of a trajectory correcting device in the trajectory correction apparatus according to an exemplary embodiment of the present invention.
Figure 5:
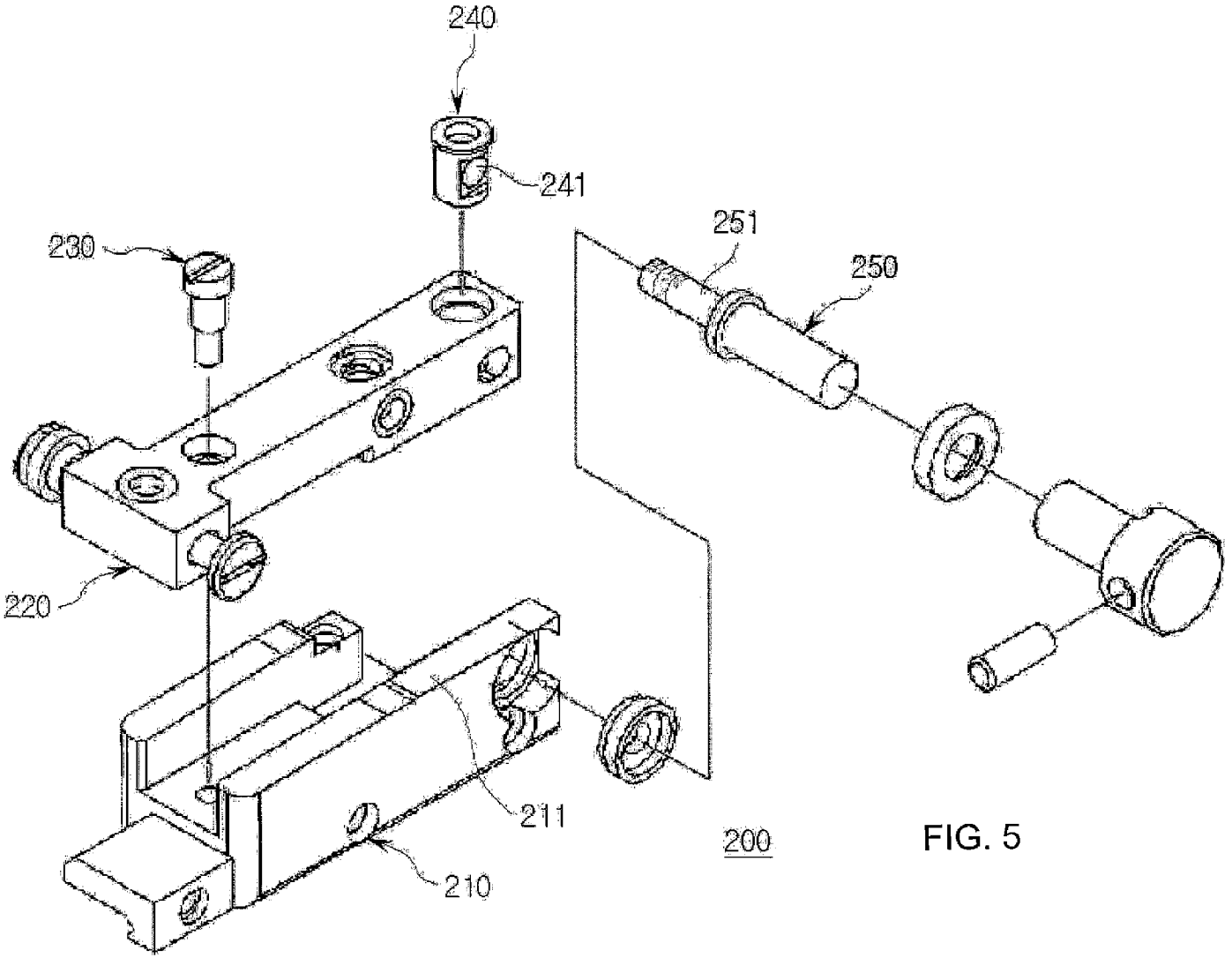
FIG. 5 is an exploded perspective view of a wind correcting device in the trajectory correction apparatus according to an exemplary embodiment of the present invention.

Among the accompanying drawings, FIG. 3 is a perspective view of a trajectory correction apparatus according to an exemplary embodiment of the present invention, FIG. 4 is an exploded perspective view of a trajectory correcting device in the trajectory correction apparatus according to an exemplary embodiment of the present invention, and FIG. 5 is an exploded perspective view of a wind correcting device in the trajectory correction apparatus according to an exemplary embodiment of the present invention.

As shown therein, the trajectory correction apparatus according to an exemplary embodiment of the present invention roughly includes a trajectory correcting device 100 fixed to a body of a firearm, and a wind correcting device 200 placed on the trajectory correcting device 100, and a sight S is installed on the wind correcting device 200.

Here, the trajectory correcting device 100 not only vertically adjusts the sight S in accordance with distance from a target so that a bullet can hit an aimed target while the gravity causes the bullet to fly forming a parabola with respect to a vertical direction, but also horizontally adjusts the sight S so that the bullet can correctly hit the target while the Coriolis' force (deflecting force) causes a moving direction of the bullet to be deflected rightward in the northern hemisphere.

Further, since the bullet deviates laterally on account of the direction and speed of the wind while the bullet is hurled from a muzzle and moves to the target, the wind correcting device 200 selectively moves the sight S in a horizontal direction in accordance with the direction and speed of the wind so that the bullet can correctly hit the target.

As shown in FIG. 4, the trajectory correcting device 100 includes a mount 110, a moving body 120, a joint shaft 130, a rotation shaft 140, an adjusting member 150, a guide plate 160, and an elastic member 170.

The mount 110 includes a firearm mounting part 111 placed in a bottom of the mount 110 and inserted in and mounted to a mounting groove of the firearm body; a locking member 112 pressing the firearm body to thereby firmly fasten the firearm mounting part 111 to the firearm body at an upper side of the firearm mounting part 111 inserted in and mounted to the mounting groove, and including a foldable grip 112*a* on the top thereof; and a pair of lateral plates 113 vertically embedded at upper opposite sides.

The moving body 120 is formed with a projection 121 at one side and arranged in a space between the opposite lateral plates 113 of the mount 110.

The joint shaft 130 is vertically inserted in the moving body 120, and the rotation shaft 140 horizontally penetrates and couples the opposite lateral plates 113 of the mount 110 and the joint shaft 130. Thus, the moving body 120 horizontally rotates with respect to the joint shaft 130, and vertically rotates with respect to the rotation shaft 140.

The adjusting member 150 is to vertically rotate the moving body 120 where the sight is installed, so that a vertical trajectory curve can intersect the target in accordance with the distance from the target even though the bullet is affected by the gravity and flies forming a parabola with respect to the vertical direction. The adjusting member 150 includes a coaxial shaft 151 rotatably installed in the lateral plate 113 of the mount 110, and a polygonal cam 152 formed with a plurality of contact surfaces different in distance from the center of the coaxial shaft 151 from one another and being in surface-contact with the moving body 120.

In particular, there are provided two or more adjusting members 150 so as to have different adjustable ranges with regard to a rotation angle of the moving body 120. For instance, if one adjusting member 150 has an adjustable range of 0~5° for the rotation angle of the moving body 120, the other adjusting member 150 is set up to have an adjustable range of 6~10° for the rotation angle. At this time, the adjusting member 150 stepwise adjusts the rotation angle while the polygonal cam 152 is in surface contact with the moving body 120 in accordance with setup distances, and a setup angle is prevented from voluntarily changing due to vibration or shock since the polygonal cam 152 is in surface contact with the moving body 120.

The guide plate 160 is to horizontally rotate the moving body 120 where the sight is installed, so that a horizontal trajectory curve can interest the target in accordance with the distance from the target even through the bullet is affected by the Coriolis' force (deflecting force) and deviates laterally with respect to its moving direction. The guide plate 160 is obliquely formed with a guide groove 161 thereon, in which the projection 121 of the moving body 120 is inserted, so that it can be fastened to one side of the mount 110. Thus, the projection 121 formed at one side of the moving body 120 moves along the oblique guide groove 161 of the guide plate 160 while the moving body 120 is vertically moved by the adjusting member 150, so that the moving body 120 can horizontally rotate with respect to the joint shaft 130.

Figure 14:
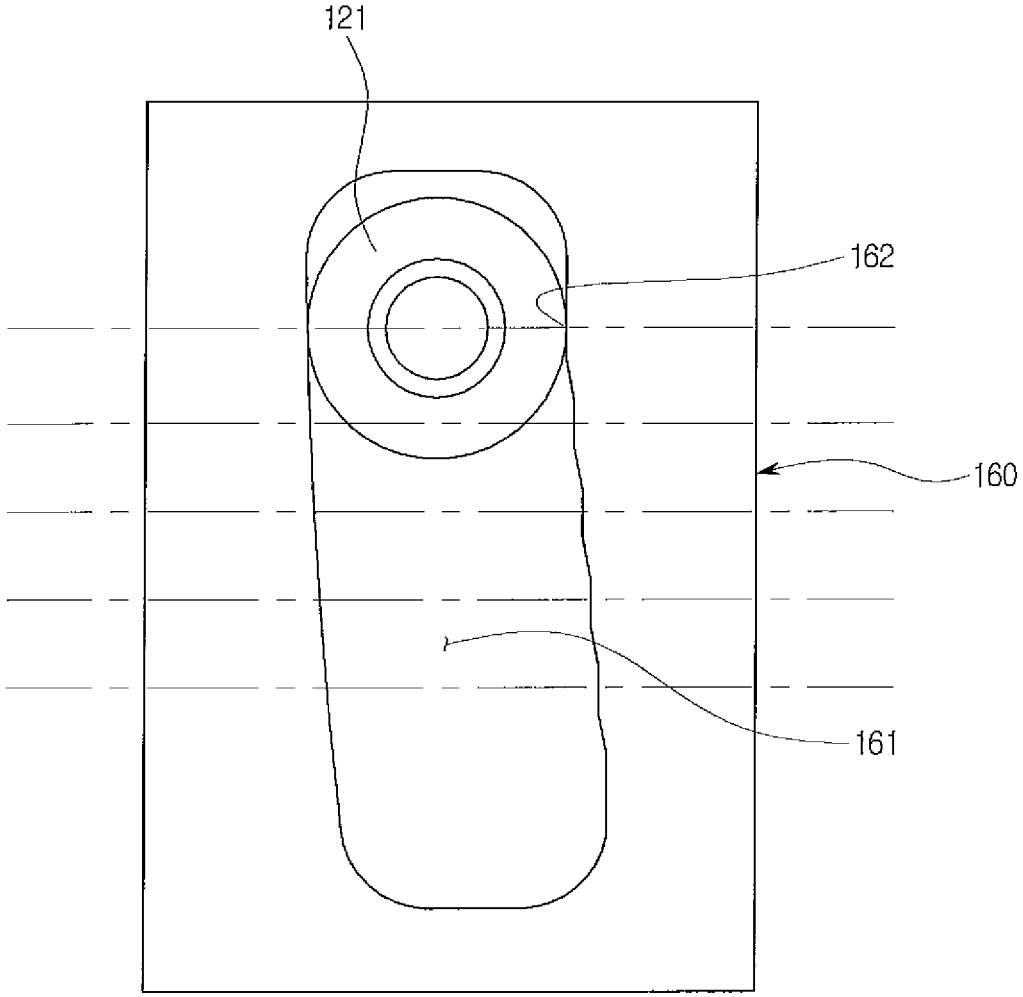
FIG. 14 is a front view of a guide plate of the trajectory correction apparatus according to an exemplary embodiment of the present invention.

At this time, the guide groove 161 of the guide plate 160 is prevented from voluntarily changing in a horizontal setup angle by vibration or shock because a part of the guide groove 161 being in contact with the projection 121 forms a vertical plane 162 in accordance with the stepwise adjusting angle of the adjusting member 150 (refer to FIG. 14).

The elastic member 170 is interposed between the mount 110 and the moving body 120, and elastically urges the moving body 120 toward the polygonal cam 152 of the adjusting member 150. In this exemplary embodiment, a coil spring is used as the elastic member 170.

The wind correcting device 200 is provided between the trajectory correcting device 100 and the sight and horizontally rotates the sight in accordance with the direction and speed of the wind.

As shown in FIG. 5, the wind correcting device 200 includes a base 210 formed with a narrow plate 211 at least at one side and installed in or formed integrally with the upper side of the moving body 120 of the trajectory correcting device 100, a sight installing platform 220 formed on the base 210, a pivot 230 penetrating the sight installing platform 220 and vertically installed in the base 210, and a moving unit horizontally rotating the sight installing platform 220 with respect to the pivot 230.

Here, the moving unit includes a joint shaft 240 vertically inserted in the sight installing platform 220, and an adjusting shaft 250 having one end coupled to the joint shaft 240 and the other end rotatably installed in the base 210. The joint shaft 240 is formed with a screw hole 241 intersecting an axial direction, and the adjusting shaft 250 is formed with a screw part 251 to be screw-coupled with the screw hole 241 of the joint shaft 240, so that the sight installing platform 220 can horizontally rotate with respect to the pivot 230 as the adjusting shaft 250 rotates. At this time, each pitch of the screw hole 241 of the joint shaft 240 and the screw 251 of the adjusting shaft 250 may be designed to involve the entire horizontal movable range of the sight installing platform 220 within one revolution of the adjusting shaft 250.

In the foregoing exemplary embodiment, the joint shaft 240 and the adjusting shaft 250 are screw-coupled, but not limited thereto. Alternatively, the joint shaft 240 and the adjusting shaft 250 may be connected and the adjusting shaft 250 and a coupling part of the base 210 may be screw-coupled.

From now on, operation of the trajectory correcting device 100 of the foregoing trajectory correction apparatus will be described.

Figure 6:
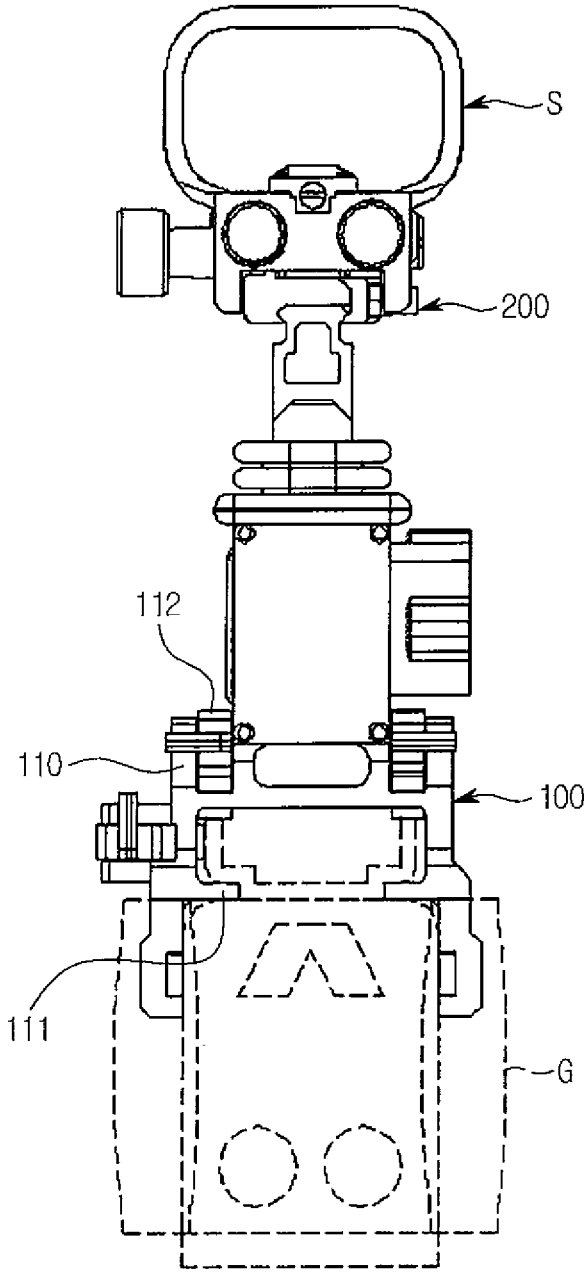
FIG. 6 is a lateral view showing an assembled state of the trajectory correction apparatus according to an exemplary embodiment of the present invention.
Figure 7:
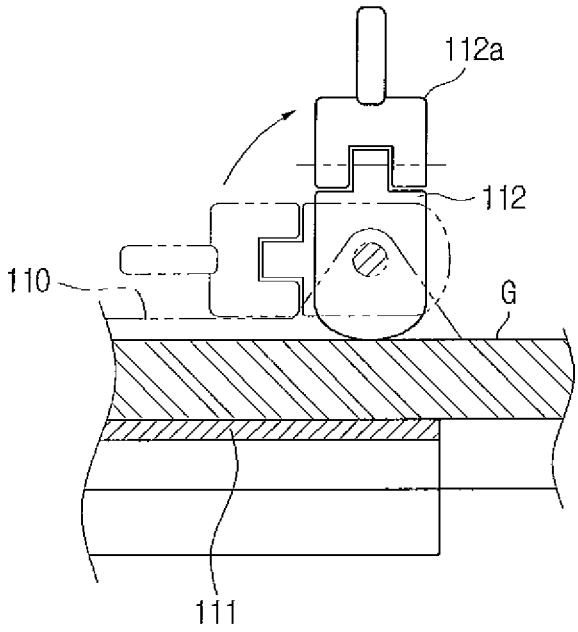
FIGS. 7 and 8 are sectional views of a locking member in the trajectory correction apparatus according to an exemplary embodiment of the present invention.
Figure 8:
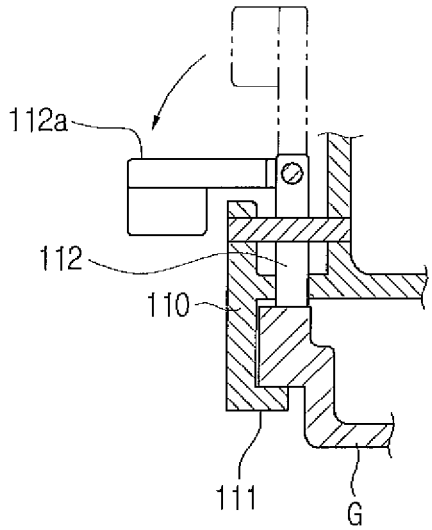

Among the accompanying drawings, FIG. 6 is a lateral view showing an assembled state of the trajectory correction apparatus according to an exemplary embodiment of the present invention, and FIGS. 7 and 8 are sectional views of a locking member in the trajectory correction apparatus according to an exemplary embodiment of the present invention.

As shown in FIG. 6, the trajectory correction apparatus in this exemplary embodiment includes the trajectory correcting device 100 and the wind correcting device 200 installed on the firearm G, and the sight S is installed on the wind correcting device 200.

Referring to the assembled state between the trajectory correcting device 100 and the firearm G, as shown in FIG. 7, if the locking member 112 rotatably formed in the mount 110 is rotated in the state that the firearm mounting part 111 is inserted in the mounting groove of the firearm G, one side of the locking member 112 presses the firearm G toward the firearm mounting part 111 so that the trajectory correcting device 100 and the firearm G can be firmly assembled. Then, as shown in FIG. 8, the grip 112*a* foldably provided on the top of the locking member 112 is folded, thereby preventing the locking member 112 not only from being voluntarily released but also from interfering with operations of other adjacent members.

From now on, operation of the trajectory correcting device 100 of the trajectory correction apparatus in this exemplary embodiment will be described.

Figure 9:
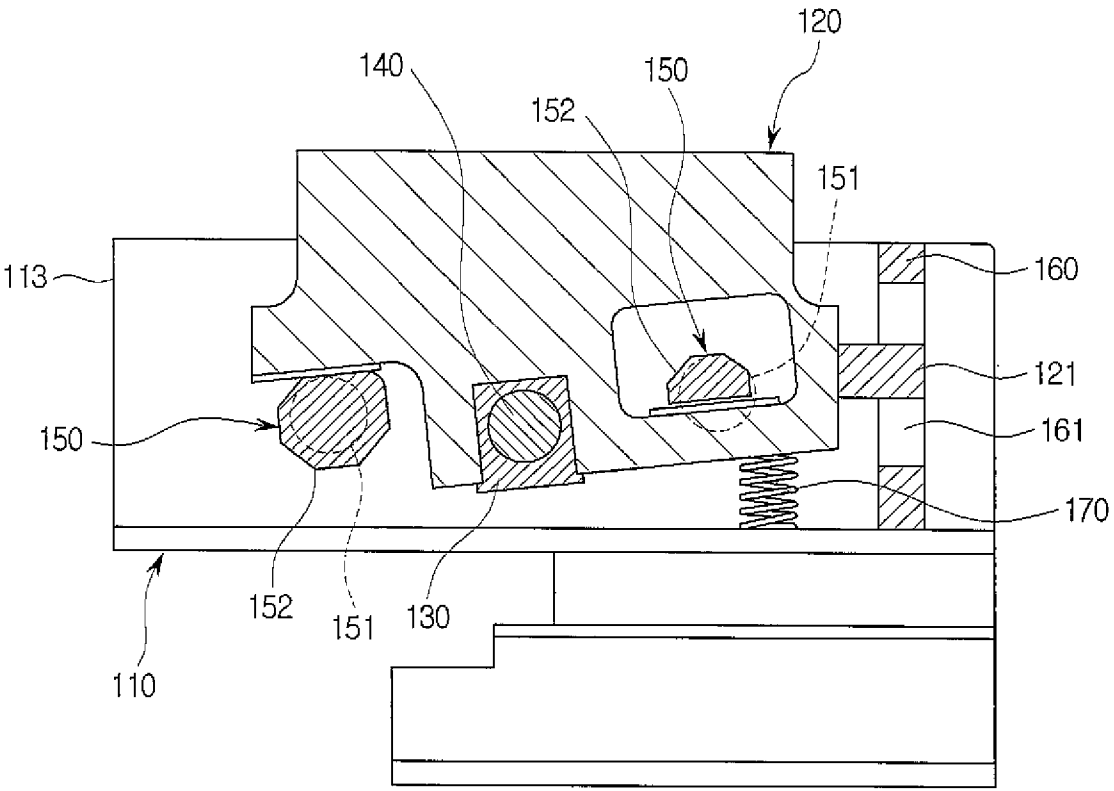
FIG. 9 is a sectional view taken along line I-I in FIG. 3, FIGS. 10 and 11 are sectional views showing correcting operations of a vertical trajectory curve in the trajectory correction apparatus according to an exemplary embodiment of the present invention.
Figure 10:
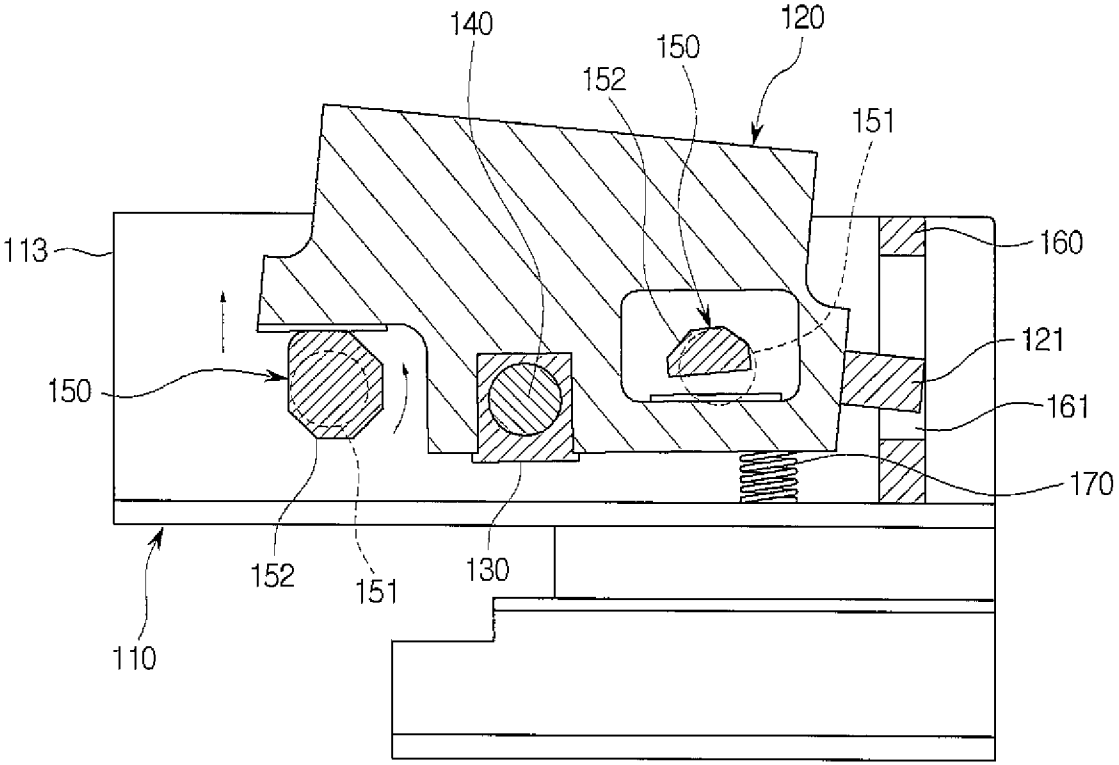
Figure 11:
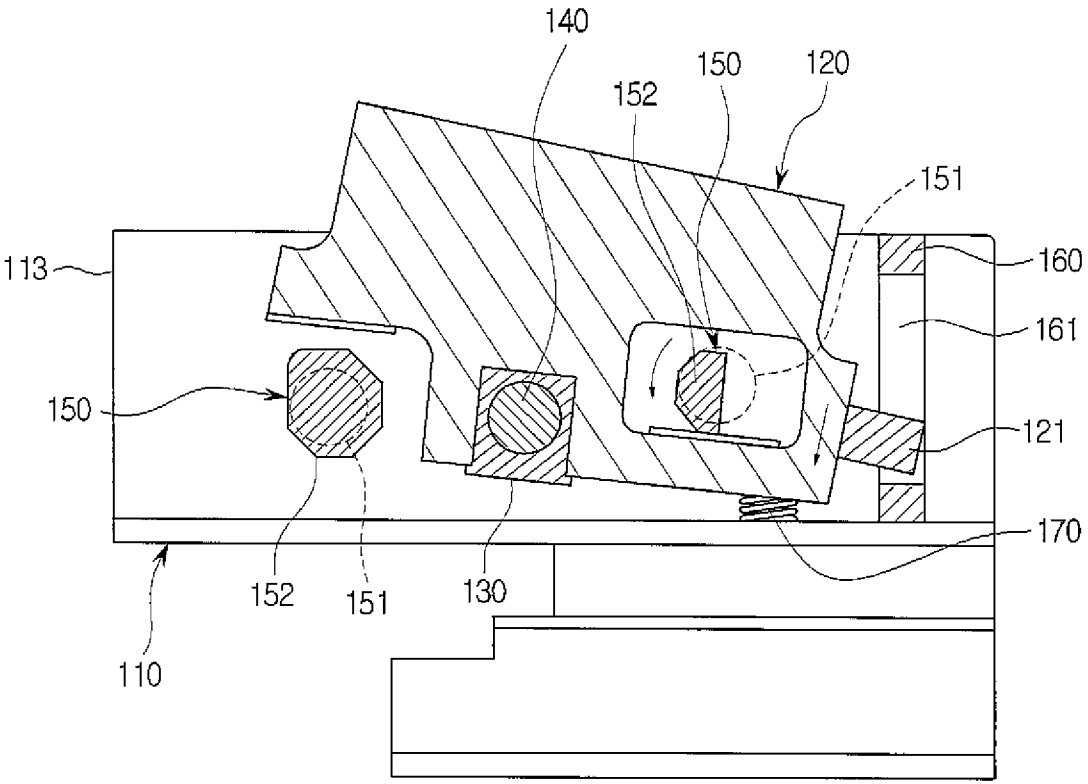

Among the accompanying drawings, FIG. 9 is a sectional view taken along line I-I in FIG. 3, and FIGS. 10 and 11 are sectional views showing correcting operations of a vertical trajectory curve in the trajectory correction apparatus according to an exemplary embodiment of the present invention.

As shown in FIG. 9, the moving body 120 arranged between the mount 110 and the lateral plate 113 is horizontally rotated with respect to the joint shaft 130 inserted in the lower part thereof, and vertically rotated with respect to the rotation shaft 140 penetrating the joint shaft 130.

Here, in the state that the moving body 120 is pressed toward the polygonal cam 152 of the adjusting member 150 by the elastic member 170 elastically inserted between the moving body 120 and the mount 110, the polygonal cam 152 of the adjusting member 150 provided at one side (see the left side in the drawing) is in contact with the moving body 120 through a contact surface thereof having the shortest distance from the center of the coaxial shaft 151, and the polygonal cam 152 of the adjusting member 150 provided at the other side (see the right side in the drawing) is also positioned so that a contact surface thereof having the shortest distance from the center of the coaxial shaft 151 faces toward the moving body 120. At this time, the sight provided on the moving body 120 parallels a gun barrel of the firearm.

In the state set up as above, the line of the sight keeps parallel with the gun barrel of the firearm. In this case, as shown in FIG. 1, if the target is positioned in a short distance like a place A where be vertical trajectory curve intersects the line of the sight, it can be rightly aimed.

Meanwhile, as shown in FIG. 1, the vertical trajectory curve starts falling down at a predetermined distance or more, and therefore an installation angle of the sight S fastened to the firearm G has to be rotated for the target positioned at a predetermined distance or more, so that the vertical trajectory curve of the bullet falling down can intersect the target at a desired distance. That is, to make the vertical trajectory curve intersect a middle distance target positioned at a place B, the vertical trajectory curve has to become higher by lifting up the gun barrel of the firearm while the sight S aims at the target. As shown in FIG. 10, if one adjusting member 150 is rotated so that the contact surface having the longest distance from the center can be in contact with the moving body 120, the moving body 120 is inclined at a predetermined angle while rotating with respect to the rotation shaft 140.

That is, if the installation angle of the sight arranged on the moving body 120 is adjusted in accordance with the distance from the target in order to aim the target, the gun barrel of the firearm G is lifted up by a predetermined angle and the vertical trajectory curve becomes higher as shown in FIG. 1, so that the vertical trajectory curve can intersect the target positioned at the place B.

While the rotation angle of the moving body 120 is adjusted through one adjusting member 150, the contact surface having the shortest distance from the center faces toward the moving body 120 in the case of the other adjusting member 150. Here, while one adjusting member 150 is rotated, there is no interference with the other adjusting member 150.

Accordingly, as shown in FIG. 1, with regard to the target positioned within a distance D1, while rotating one adjusting member 150, a plurality of contact surfaces provided in the polygonal cam 152 of the adjusting member 150 becomes in contact with the moving body 120, thereby making the vertical trajectory curve intersect the target in accordance with each setup distance.

Meanwhile, as shown in FIG. 1, to make the vertical trajectory curve intersect a target positioned at a place C, the vertical trajectory curve has to become higher by lifting up the gun barrel of the firearm. As shown in FIG. 11, if the other adjusting member 150 is rotated to make the contact surface having the longest distance from the center become in contact with the moving body 120, the moving body 120 where the sight is installed is rotated with respect to the rotation shaft 140 and additionally inclined.

That is, if the installation angle of the sight arranged on the moving body 120 is adjusted in accordance with the distance from the target in order to aim the target, the gun barrel of the firearm G is lifted up by a predetermined angle and the vertical trajectory curve becomes higher as shown in FIG. 1, so that the vertical trajectory curve can intersect the target positioned at the place C.

While the rotation angle of the moving body 120 is adjusted through the other adjusting member 150, the rotation angle of the moving body 120 is set up to be out of the range of the rotation angle adjustable through one adjusting member 150. Therefore, while the rotation angle of the moving body 120 is adjusted through the other adjusting member 150, there is no interference with one adjusting member 150.

Accordingly, as shown in FIG. 1, with regard to the target positioned within a distance D2, while rotating the other adjusting member 150, one contact surface among a plurality of contact surfaces provided in the polygonal cam 152 of the adjusting member 150 selectively becomes in contact with the moving body 120, thereby making the vertical trajectory curve intersect the target in accordance with each setup distance.

As described above, there are provided two or more adjusting members 150 for vertically adjusting the rotation angle of the moving body 120, and the respective adjusting members 150 are set up to be different from each other in a range of adjusting the vertical rotation angle of the moving body 120, so that the sight can be accurately adjusted in accordance with the distance, thereby improving the accuracy rate of the firearm.

Figure 2:
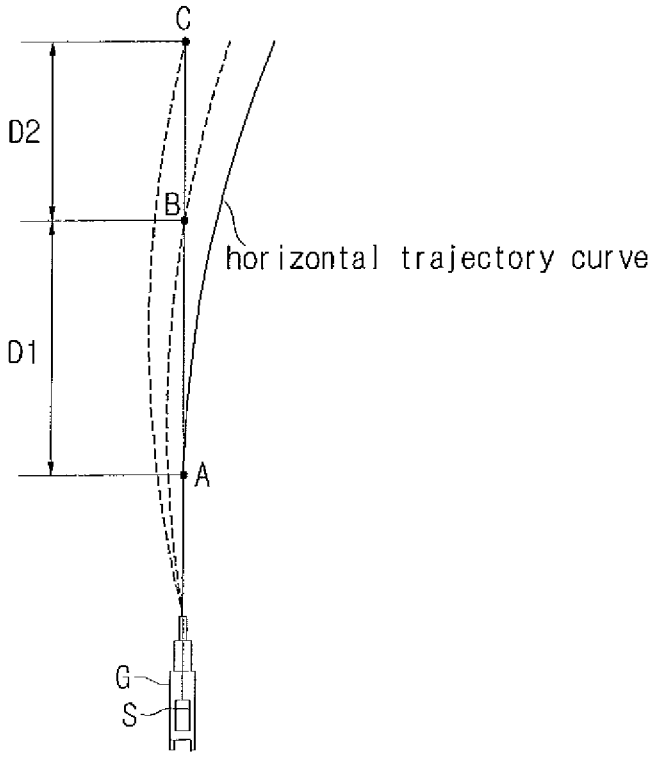
FIG. 2 is a schematic view showing a trajectory curve of a bullet affected by Coriolis' force (deflecting force) in a horizontal direction.

The trajectory correction apparatus according to an exemplary embodiment of the present invention has to rotate the sight in the horizontal direction in accordance with the distance from the target since the Coriolis' force (deflecting force) causes the horizontal trajectory curve (see FIG. 2) to deflect rightward with regard to the moving direction of the bullet in the northern hemisphere. That is, while the moving body 120 where the sight is installed is vertically rotated in accordance with the distance from the target, the moving body 120 is automatically rotated in the horizontal direction along the horizontal trajectory curve, so that an error in the horizontal direction can be corrected with the horizontal trajectory curve.

Figure 12:
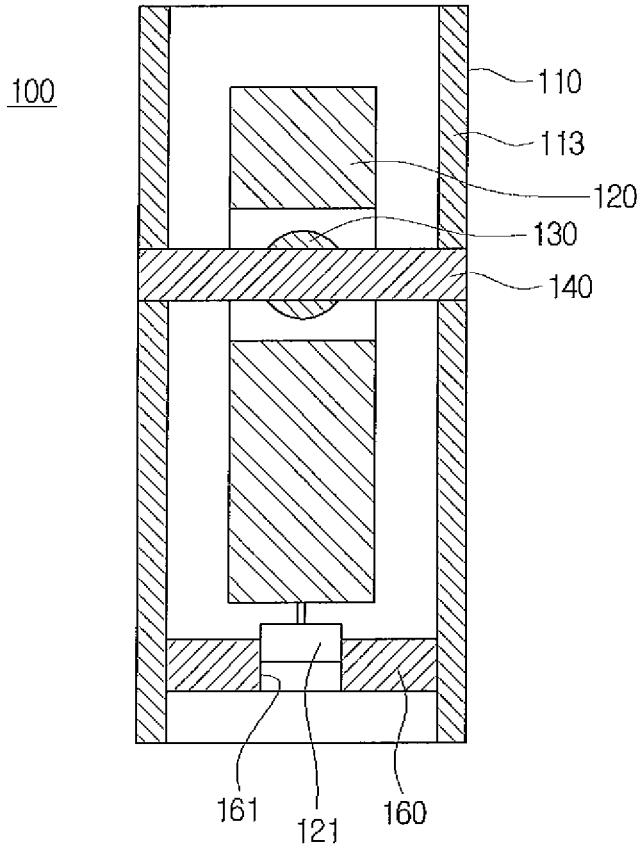
FIG. 12 is a sectional view taken along fine II-II in FIG. 3.
Figure 13:
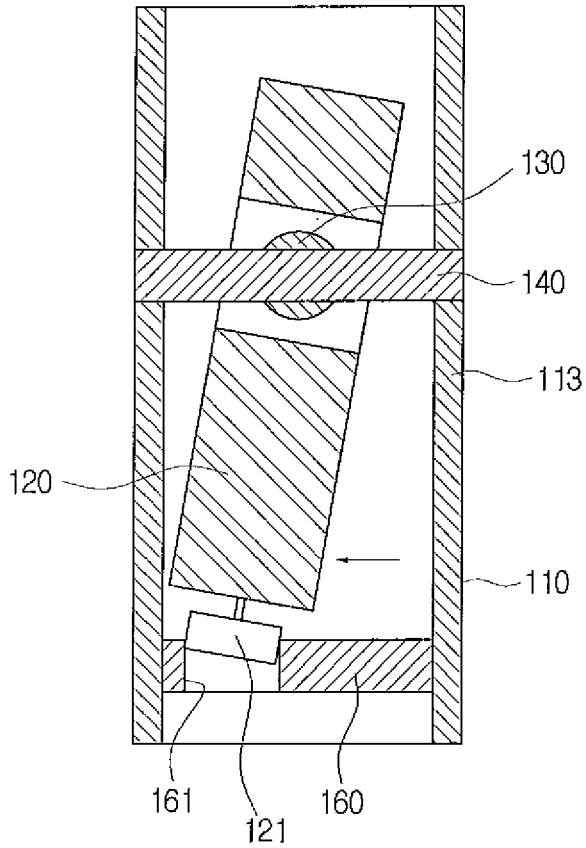
FIG. 13 is a sectional view showing a correcting operation of a horizontal trajectory curve in the trajectory correction apparatus according to an exemplary embodiment of the present invention.

Among the accompanying drawings, FIG. 12 is a sectional view taken along line II-II in FIG. 3, FIG. 13 is a sectional view showing a correcting operation of a horizontal trajectory curve in the trajectory correction apparatus according to an exemplary embodiment of the present invention, and FIG. 14 is a front view of a guide plate of the trajectory correction apparatus according to an exemplary embodiment of the present invention.

First, as shown in FIG. 12, in the state that the gun barrel of the firearm parallels the line of the sight, that is, in the state that the mount 110 installed in the firearm and the moving body 120 where the sight is installed are arranged parallel with each other, the moving body 120 can vertically rotate with respect to the rotation shaft 140 as well as horizontally rotate with respect to the joint shaft 130.

Also, if the projection 121 protruding from one side of the moving body 120 is inserted in the guide groove 161 of the guide plate 160 fastened between the lateral plates 113 of the mount 110, and the moving body 120 is rotated by the foregoing adjusting member 150 with respect to the rotation shaft 140, the projection 121 moves along the guide groove 161 of the guide plate 160 as shown in FIG. 13, so that the moving body 120 can horizontally rotate with respect to the joint shaft 130. That is, the horizontal rotation of the moving body 120 can be automatically achieved with respect to the vertical rotation.

As above, the guide groove 161 obliquely formed on the guide plate 160 is to correct that the Coriolis' force (deflecting force) causes the bullet to deflect rightward with respect to its moving direction. Thus, while the moving body 120 is rotated vertically to make the vertical trajectory curve interest the target in accordance with the distance from the target, the moving body 120 is rotated even in the horizontal direction by interlocking with the vertical movement, so that an error in the horizontal trajectory curve can be corrected in accordance with the distance.

Meanwhile, as shown in FIG. 14, the guide groove 161 of the guide plate 160, in which the projection 121 of the moving body 120 is inserted and which guides the horizontal rotation of the moving body 120, is obliquely formed to guide the moving body 120 moving in the vertical direction to move in the horizontal direction. At this time, a plane where the guide groove 161 and the projection 121 are in contact with each other is formed as a vertical plane 162 within a predetermined range according to the respective rotating steps of an adjusting unit (not shown), so that the horizontal rotated angle of the moving body 120 is prevented from changing due to a shock at percussion of the firearm.

Below, operation of the wind correcting device 200 of the trajectory correction apparatus according to an exemplary embodiment of the present invention will be described.

Figure 15:
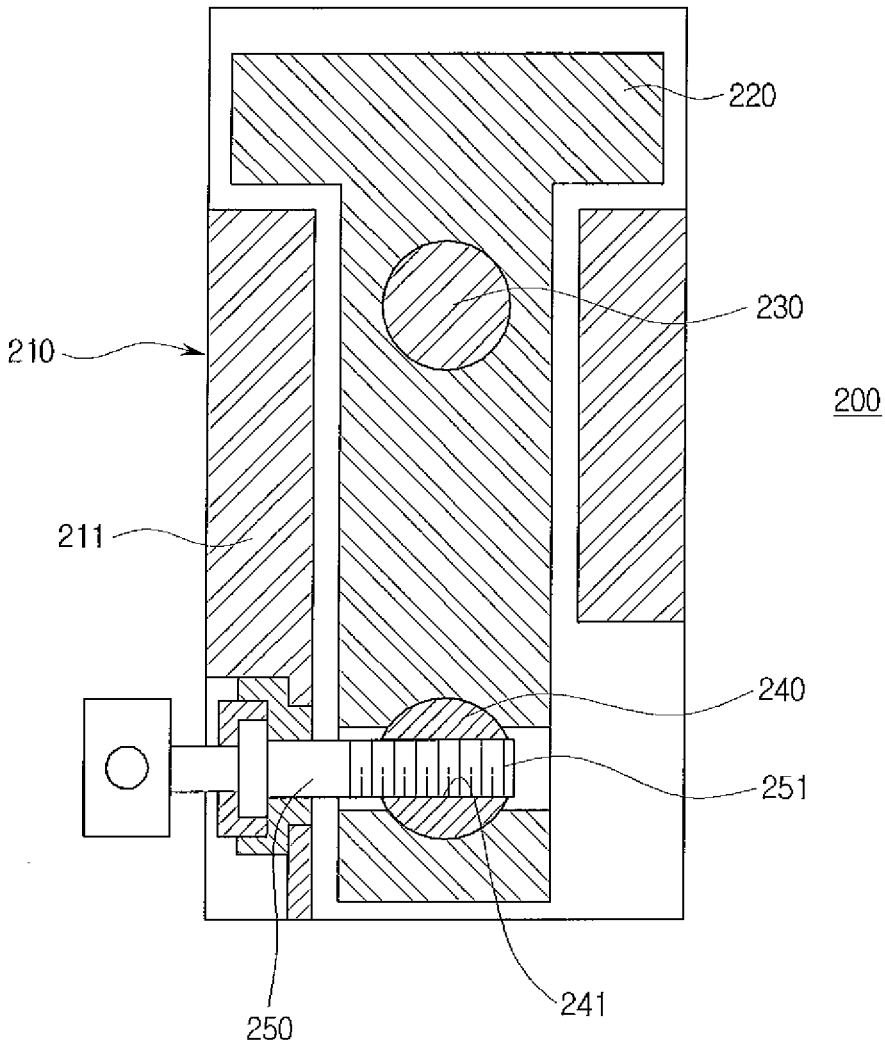
FIG. 15 is a sectional view taken along line III-III in FIG. 3.
Figure 16:
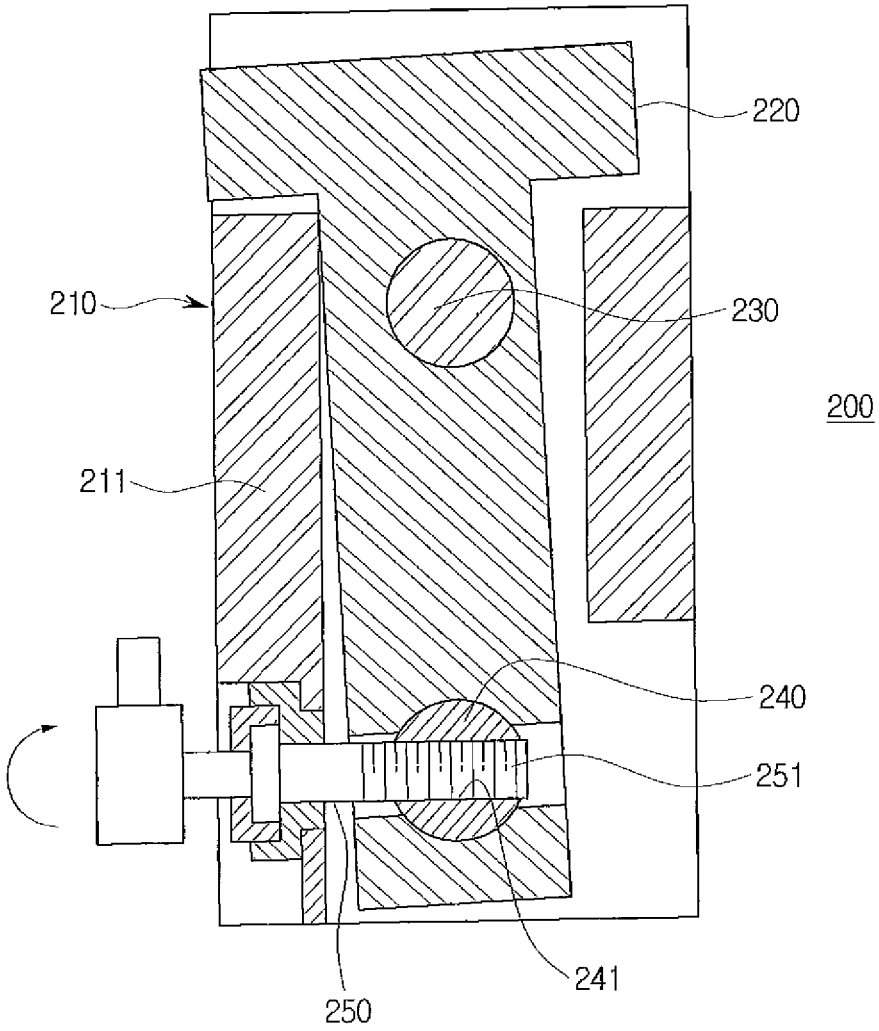
FIG. 16 is a sectional view of a correcting operation based on the wind in the trajectory correction apparatus according to an exemplary embodiment of the present invention.

Among the accompanying drawings, FIG. 15 is a sectional view taken along line III-III in FIG. 3, and FIG. 16 is a sectional view of a correcting operation based on the wind in the trajectory correction apparatus according to an exemplary embodiment of the present invention.

As shown in FIG. 15, the wind correcting device 200 of the trajectory correction apparatus in this exemplary embodiment is to horizontally rotate the sight installing platform 220, where the sight is installed, in accordance with the direction and speed of the wind and to correct that the bullet deviates from an aiming point due to the direction and speed of the wind. The wind correcting device 200 includes a base assembled to or formed integrally with the upper side of the moving body 120 of the foregoing trajectory correcting device 100.

That is, in the state that the sight installing platform 220 is arranged on an upper side of the base 210 provided on the upper side of the moving body 120, the sight installing platform 220 can be horizontally rotated with respect to the pivot 230 that vertically penetrates one end part of the sight installing platform 220 and is fastened to the base 210.

Further, the joint shaft 240 is vertically inserted in the other end part of the sight installing platform 220, and a front end part of the adjusting shaft 250 rotatably installed in the narrow plate 211 of the base 210 is transversely screw-coupled to the joint shaft 240.

Thus, as shown in FIG. 16, if a shooter measures the direction and speed of the wind and rotates a lever of the adjusting shaft 250 in accordance with the wind, the joint shaft 240 screw-coupled to the front end part of the adjusting shaft 250 moves leftward or rightward along the screw part 251 of the adjusting shaft 250 so that the sight installing platform 220 in which the joint shaft 240 is inserted can horizontally rotate with respect to the pivot 230, thereby correcting an error due to the wind in the trajectory curve.

Meanwhile, each pitch of the screw hole 241 of the joint shaft 240 and the screw 251 of the adjusting shaft 250 may be formed to involve the entire rotating region of the sight installing platform 220 within one revolution of the adjusting shaft 250, so that it can be quickly and conveniently handled.

According to exemplary embodiments of the present invention, there is provided a trajectory correction apparatus, which can improve an accuracy rate by rightly aiming and shooting a target through a dot sight, a scope or the like sight as an error is corrected in consideration of a vertical trajectory and a horizontal trajectory according to distance from the target, and which can automatically correct the horizontal trajectory when the vertical trajectory is corrected depending on the distance from the target.

Also, there is provided a trajectory correction apparatus, in which a trajectory is corrected through two or more adjusting members to thereby make fine adjustment possible in accordance with the distance from the target, and an adjustable range of each adjusting member is divided according to the distance from the target to thereby quickly and correctly correspond to the distance from the target.

Further, there is provided a trajectory correction apparatus which can prevent a corrected trajectory from being lost by a shock at percussion.

Furthermore, there is provided a trajectory correction apparatus which can improve an accuracy rate by correcting an error that a bullet deviates from a target on account of the direction and speed of wind while the bullet hurled from a muzzle arrives at the target.

Although the present invention has been described with reference to the embodiments and the accompanying drawings, the present invention is not limited to these embodiments and the drawings. It should be understood that various modifications, additions and substitutions can be made by a person having ordinary knowledge in the art without departing from the scope and spirit of the invention as disclosed in the accompanying claims.

What is claimed is:

1. A trajectory correction apparatus arranged between a firearm and a sight, the trajectory correction apparatus comprising:

a trajectory correction device which comprises a mount mounted to a firearm body, a moving body having a projection at one side and arranged on an upper side of the mount, a joint shaft rotatably inserted in the moving body, a rotation shaft installed to the mount and penetrating the joint shaft and the mount in a direction perpendicular to both the joint shaft and the mount, an adjusting member adjusting a vertical rotation angle of the moving body, and a guide plate obliquely formed thereon with a guide groove, in which the projection is inserted, and fastened to one side of the mount to horizontally rotate the moving body as the moving body vertically rotates.

2. The trajectory correction apparatus according to claim 1, wherein a region of the guide groove with which the projection comes into contact in accordance with adjusting steps of a vertical rotating angle of the moving body is formed as a vertical plane.

3. The trajectory correction apparatus according to claim 2, wherein two or more adjusting members are provided, and the respective adjusting members are different in an adjustable range for the rotation angle of the moving body.

4. The trajectory correction apparatus according to claim 3, wherein the adjusting member comprises a coaxial shaft and a polygonal cam having a plurality of contact surfaces spaced apart from each other and located a distance away from a center of the coaxial shaft, wherein the plurality of contact surfaces are formed to be in surface-contact with the moving body in accordance with a distance from the sight to an impact point of a bullet.

5. The trajectory correction apparatus according to claim 4, further comprising an elastic member interposed between the mount and the moving body and elastically supporting the moving body in one direction.

6. The trajectory correction apparatus according to claim 1, further comprising a wind correcting device which is provided between the trajectory correcting device and the sight and horizontally rotates the sight in accordance with direction and speed of wind.

7. The trajectory correction apparatus according to claim 6, wherein the wind correcting device comprises a base fastened to an upper side of the moving body of the trajectory correcting device, a sight installing platform arranged on an upper side of the base, a pivot penetrating the sight installing platform and installed in the base, and a moving unit horizontally rotating the sight installing platform with respect to the pivot.

8. The trajectory correction apparatus according to claim 7, wherein the moving unit comprises a joint shaft rotatably inserted in the sight installing platform, and an adjusting shaft having one end coupled to the joint shaft and the other end rotatably installed to the base, and the joint shaft and a coupling part of the adjusting shaft or the adjusting shaft and a coupling part of the base are screw-coupled.

* * * * *